US006199602B1

(12) United States Patent
Maginot et al.

(10) Patent No.: US 6,199,602 B1
(45) Date of Patent: Mar. 13, 2001

(54) LARGE DRUMS FOR HIGH-DISPERSION, HIGH AIR CONTENT SOLIDS, AND A METHOD FOR FILLING THEM

(75) Inventors: Helmut Maginot, Burgkirchen; Armin Grossmann, Burghausen, both of (DE)

(73) Assignee: Wacker-Chemie GmbH, Munich (DE)

( * ) Notice: Subject to any disclaimer, the term of this patent is extended or adjusted under 35 U.S.C. 154(b) by 0 days.

(21) Appl. No.: 09/383,676

(22) Filed: Aug. 26, 1999

(30) Foreign Application Priority Data

Aug. 27, 1998 (DE) ..... 198 39 106

(51) Int. Cl.[7] ..... B65B 1/04

(52) U.S. Cl. ..... 141/59; 141/313; 383/101; 383/102; 383/113; 383/116; 55/361; 55/364; 55/372; 55/382

(58) Field of Search ..... 55/361, 364, 372, 55/387, 382; 383/101, 102, 113, 116; 141/59, 65, 313

(56) References Cited

U.S. PATENT DOCUMENTS

| | | | | |
|---|---|---|---|---|
| Re. 34,560 | * | 3/1994 | Schnaars | 383/113 |
| 4,187,390 | * | 2/1980 | Gore | 55/486 |
| 4,229,193 | * | 10/1980 | Miller | 55/372 |
| 4,735,308 | * | 4/1988 | Barner | 383/113 |
| 5,293,756 | * | 3/1994 | Nelson et al. | 383/113 |
| 5,501,525 | * | 3/1996 | Cox et al. | 383/101 |
| 5,647,881 | * | 7/1997 | Zhang et al. | 55/382 |
| 5,682,929 | | 11/1997 | Maginot et al. | 141/65 |
| 5,839,832 | * | 11/1998 | Hagino | 383/101 |

FOREIGN PATENT DOCUMENTS

| | | |
|---|---|---|
| 93 07 217 | 11/1994 | (DE) . |
| 0586 994 | 3/1994 | (EP) . |
| 0761533 | 3/1997 | (EP) . |
| 0767105 | 4/1997 | (EP) . |
| 0 773 159 | 5/1997 | (EP) . |
| 1082675 | 9/1967 | (GB) . |
| 91/14632 | 10/1991 | (WO) . |

OTHER PUBLICATIONS

English Abstract corresponding to DE–G 93 07 217.
English Derwent Abstract corresponding to EP 0767 105 A1 [AN 1997—205328 [19]].
English Derwent Abstract corresponding to DE 4009 369 A1 [AN 1991—288976].

* cited by examiner

*Primary Examiner*—J. Casimer Jacyna
(74) *Attorney, Agent, or Firm*—Collard & Roe, P.C.

(57) ABSTRACT

A large drum for containing high dispersion, high air content solids for repeated filling and emptying by means of vacuum filling plants and a method for filling them. The drums consist of at least two layers, an inner layer consisting of uncoated air-permeable fabric and an outer layer being coated so as to be dust tight and provide a moisture barrier. These layers being connected to one another by means of a special seam, so that it is possible for the drum to be deaerated solely through this seam. The seam includes an air-permeable dust-retaining filter strip material disposed between the drum layers.

6 Claims, 3 Drawing Sheets

11
13
11
10
11
8
9

LARGE DRUMS FOR HIGH-DISPERSION, HIGH AIR CONTENT SOLIDS, AND A METHOD FOR FILLING THEM

BACKGROUND OF THE INVENTION

1. Field of the Invention

This invention relates to improved large drums for containing high-dispersion, high air content solids, and a method for filling them.

Handling pourable, high dispersion, and high air content solids of extremely low bulk density, such as, for example, high dispersion silicic acid (HDK), presents problems in various respects. Both manufacturers and ultimate consumers are faced with the problem that these substances cause dust with even the least amount of air convection. This dust generation should be avoided so that personnel, handling the product, are protected from any harm to their health which may be caused by breathing in the dust. Furthermore, the low bulk density results in increased transport costs, because the ratio of drum weight to filling weight is high, and a correspondingly large amount of packaging material is required.

Due to its spatial, three-dimensional branch structure, HDK is a product which has an extremely low tamped density of about 40 to 50 g/l. Moreover, the distinction must be made between the operating bulk density and the tamping density value according to DIN ISO 787/11. Due to its fine structure, HDK is capable of binding with a large amount of gas, for example, air, with the result that the product is put into a quasi-fluid state at about 20 to 30 g/l. This removable air fraction voluntarily escapes only very slowly and incompletely. This fluid state also increases the dust problem, since the mobility of HDK agglomerates is extremely high. This means, in production, that every conveying operation puts the HDK into this fluid state which then makes it more difficult to fill the drums, since the specific amount of time spent on filling each drum is increased, thus, in turn, reducing the capacity.

Pourable, high dispersion and high air content solids of extremely low bulk density, such as HDK, are therefore introduced into air-permeable bags predominantly with the aid of an externally applied vacuum. In this case, the filling duration rises with an increasing air content. The bags in this case consist of 3 to 4 layers of paper and, in addition, one layer of the paper may be lined with polyethylene (PE) as a barrier against penetrating moisture. In order to achieve the desired air permeability during filling, all the layers are microperforated. The advantage of this is that when the product is introduced into the bag, it is compressed and its filling density rises, as compared with the natural bulk density. It is also possible to carry out predeaeration by means of special press rollers, but this always results in structural damage to the HDK, which reduces its thickening property, or the thixotropic property, of the pyrogenic silicic acid.

Due to the higher weight of the product in the drum, transportation costs are reduced. However, this cost saving is at the expense of an extra outlay for procuring the special bags and the filling plant required for the bags.

2. The Prior Art

The described vacuum filling into multilayer, partially PE-lined paper bags is presently the general packaging standard for so-called "fumed silica". In this method, the problems of air permeability, dust tightness, drum stability, and moisture barrier properties are solved satisfactorily.

These paper bags, by their very nature, are unsuitable for large filling quantities. Current filling quantities for drums of this kind are usually 10–20 kg.

In European Patent No. 0 773 159 or U.S. Pat. No. 5,682,929, there is disclosed a method and a container for the repeated filling and emptying with pourable product of low bulk density. The fabric container describes the so-called big bag or super bag that has a filling capacity of 90 to 350 kg. The fabric container consists of flexible air-permeable fabric, preferably a single-layer or multilayer synthetic fabric, with at least one accessible orifice. These fabric containers are likewise filled by means of vacuum-filling systems. Here, the fabric container is evacuated, and the product is drawn through the opened orifice into the fabric container until a predetermined filling weight is reached. During this time, the gas escapes, being distributed over the entire surface of the fabric container. During filling, the product is reversibly compacted, which is similar to filling the bags without its structure being destroyed.

These drums, however, have many disadvantages. For large flexible drums, paper bags cannot be used, since, on the one hand, they do not fulfill the necessary strength and transport safety requirements and, on the other hand, multiple use is not possible. Furthermore, there are no manufacturing plants and filling devices available for these paper bag sizes.

If the commercially available large flexible drums consisting, for example, of polypropylene fabric are employed, they can be used only for transporting filling substances insensitive to moisture, since the moisture barrier property of the fabrics used is insufficient to prevent an unacceptable increase in the moisture content of the HDK. The moisture barrier property is one of the main preconditions for the widespread use of these large flexible drums for all HDK types and areas of HDK use.

SUMMARY OF THE INVENTION

It is, therefore, an object of the present invention to provide flexible and repeatedly fillable large drums which meet the required demands of primary importance.

In the invention, high air permeability is provided, in order to achieve a high filling rate. Furthermore, high drum stability and dust tightness during filling, transporting and emptying are required. On the other hand, the large flexible container is to have a moisture barrier that allows only a slight increase in moisture of the product during filling and storage.

It was not possible for the above prerequisites to be combined satisfactorily using known bag packs and large flexible drums, or any combination of these. However, by providing a special design of the flexible container to ensure dust tightness, to provide a moisture barrier property, and to provide a method for predeaeration of the high-dispersion, high air content product, thus minimizing the drum gas permeability necessary for the filling operation, while keeping the filling capacity the same, it was possible to achieve the above-mentioned benefits.

The invention therefore provides flexible drum, consisting of at least two layers disposed one above the other. The inner layer consists of uncoated air-permeable fabric, and the outer layer is coated so as to be dust tight and form a moisture barrier. These layers are connected to one another by means of a special seam design, so that it is possible for the drum to be deaerated solely through this seam design.

Thus, deaeration can take place solely via the special seams, and with an air throughput when the vacuum is applied, such as, for example, using a lower filling curve, than with known flexible drums. The high dispersion, high air content filling product is also predeaerated, prior to filling, by means of a method according to the invention. This predeaeration reduces the operating bulk density of the filling product before the inventive flexible container is filled, without the spatial structure of the filling product being affected in any way.

This method is particularly suitable for packaging high dispersion, high air content materials with an extremely low bulk density of 20 to 150 g/l, such as the various modifications of HDK. Modifications of HDK which are preferred in this case are those which can easily absorb moisture from their surroundings. It is particularly preferred to use fabric containers with a capacity of 90 to 350 kg filling weight.

Immediately after the feed silo of the large-filling container plant is filled, the HDK still has an air content. Under these conditions, the operating bulk density and the degree of agglomeration are low. By means of the predeaeration step, the operating bulk density and consequently the degree of agglomeration are increased along the route from the feed silo to the filling step. Here, the operation of filling the container can be shortened markedly, since the entire deaeration of the filling material does not have to take place during filling via the drum seam design according to the invention. The increase in the degree of agglomeration during predeaeration also reduces the dust problem, since the agglomerates obtained no longer pass through the pores of the fabric material.

During predeaeration, the gas is suction-extracted from the product via an applied vacuum through air-permeable partitions made of porous material, preferably sintered metal, fabric, or sintered plastics. However, as a result of this suction-extraction operation, a product layer begins to form on the filter medium and, with increasing layer thickness or product thickness, this would bring the suction-extraction operation to a standstill. In order to prevent this buildup, pressure pulses are applied to the product layer to release the layer. In this case, the pressure pulses for releasing this layer introduce markedly less gas into the system than is suction-extracted, so that the overall gas balance leads to deaeration.

BRIEF DESCRIPTION OF THE DRAWINGS

Other objects and features of the present invention will become apparent from the following detailed description considered in connection with the accompanying drawings which disclose the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
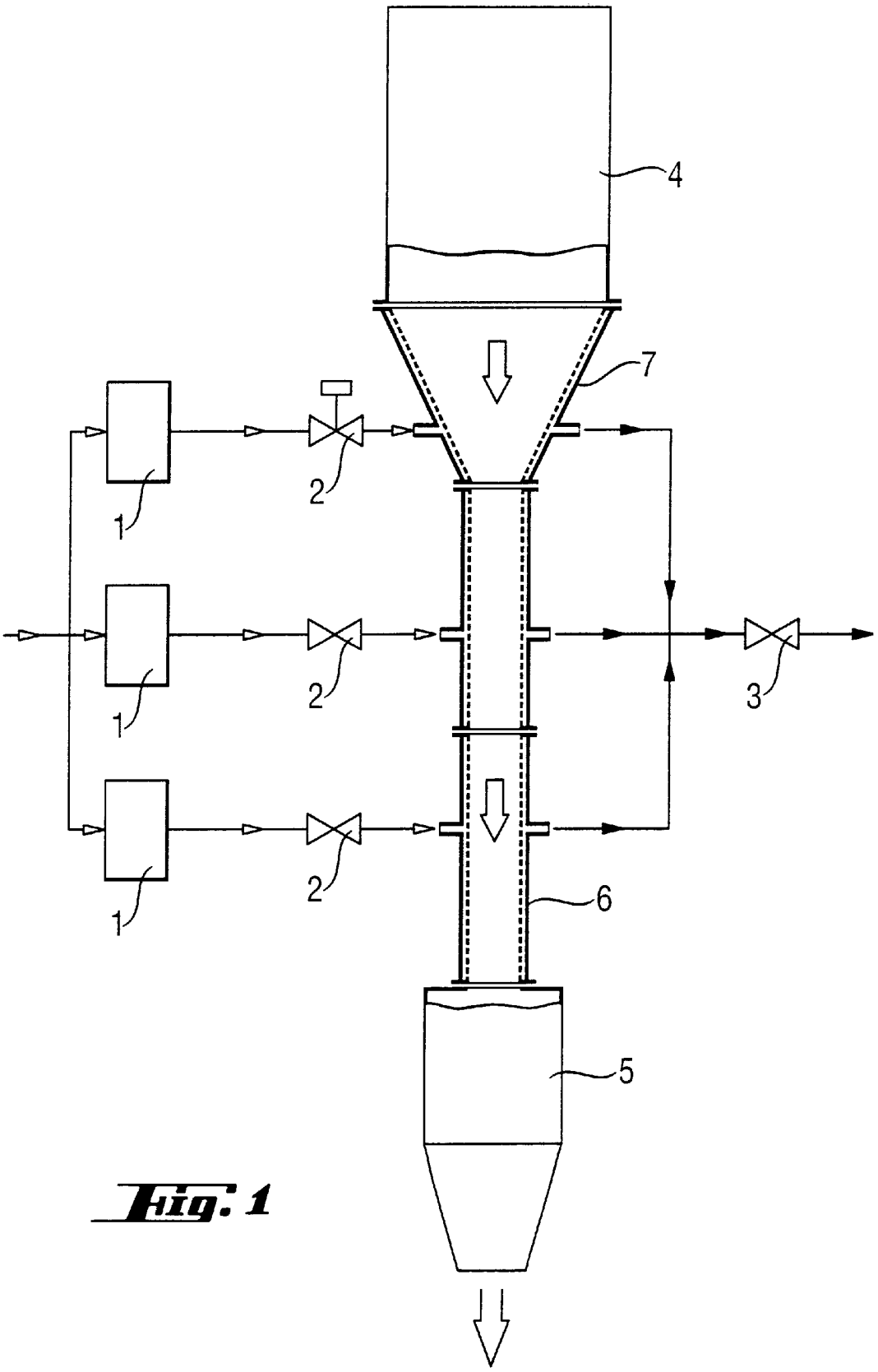
FIG. 1 is an illustration of a device according to the invention for providing predeaeration to high air content solids.

Referring to FIG. 1, there is shown a diagrammatic illustration of a device for predeaeration. The suction-extraction surface in the method according to the invention is subdivided into various segments, so that controlled deaeration can be established. Via a vacuum valve 3, the gas is suction-extracted from the bottom of a silo 4, and the tubular region through air-permeable partitions 6 and 7, made of porous material. Pulse cleaning takes place, via the compressed-air reservoirs 1, by means of the pulse-cleaning valves 2 connected to partitions 6 and 7. Cleaning by means of a pressure pulse may, in this case, take place under a vacuum, or under normal pressure. In the latter case, vacuum valve 3 is closed, and the pulse cleaning takes place after atmospheric pressure is reached. Valves 2 may be computer controlled to pulse clean the air-permeable partitions 6 and 7.

The intermittent alternate suction and discharge of the compacted product layer causes the product to move from silo 4, in which the HDK still has a high air content, into the filling bin 5 for deaerated HDK. Due to the spatial structure of the HDK material, the high degree of compaction, once reached, is maintained, as no renewed mechanical dispersion takes place. The filling operation is thereby considerably accelerated.

The large flexible containers according to the invention are subsequently filled with the predeaerated material from bin 5 by means of a known vacuum filling plant.

Figure 2:
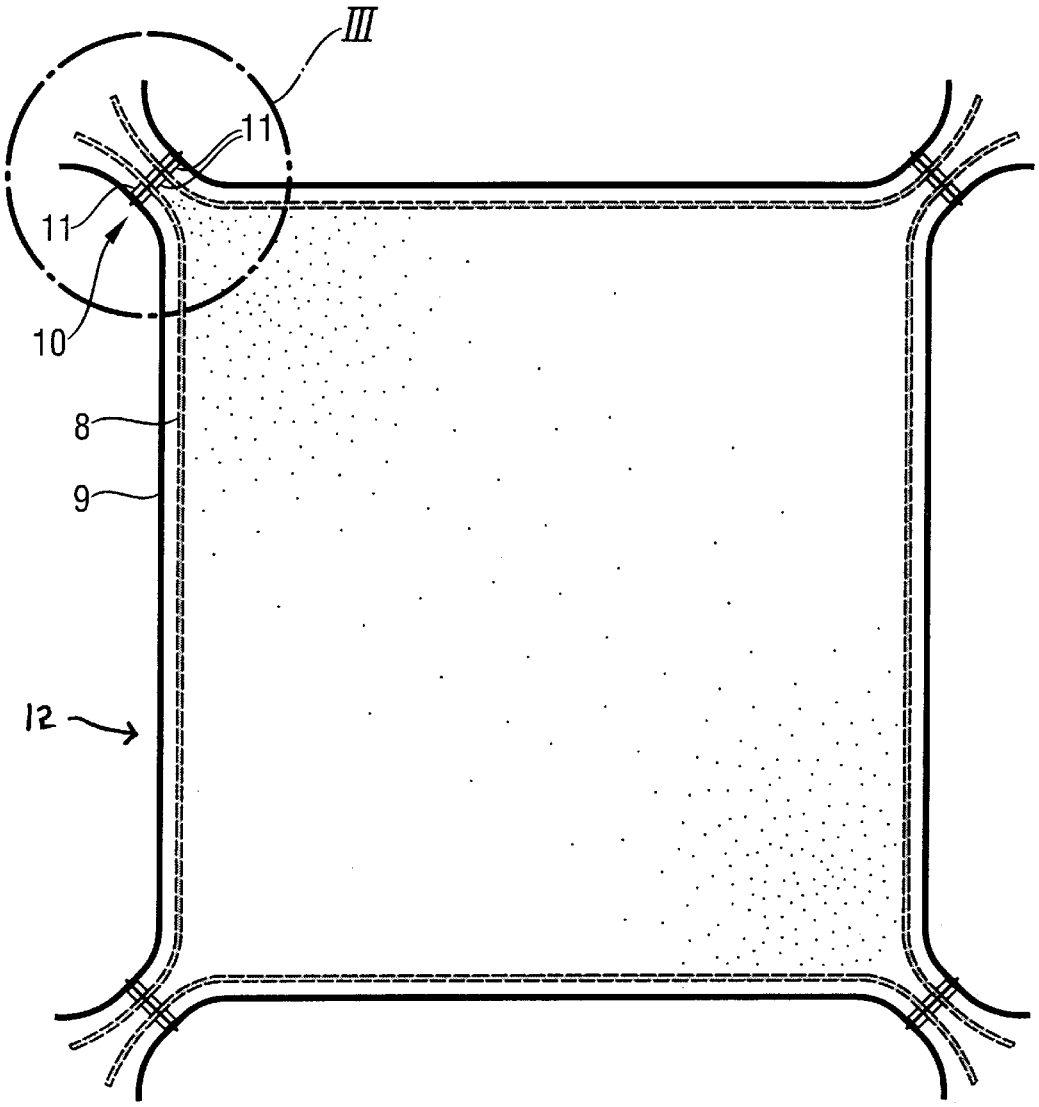
FIG. 2 is an illustration of the large flexible drums of the invention.

FIG. 2 is a diagram showing the makeup of the large flexible drums in greater clarity according to the invention. Each drum 12 consists of at least two layers, preferably of flexible fabric. An inner layer 8 consists in this case of a uncoated air-permeable fabric. An outer layer 9 is coated so as to be dust tight and form a moisture barrier, preferably with polypropylene and/or polyethylene. In contrast to the known large drums in which deaeration takes place over the entire surface during the filling operation, deaeration of the drums 12 according to the invention can be carried out solely via the special seam design 10 of the various layers, through filter material 11.

Figure 3:
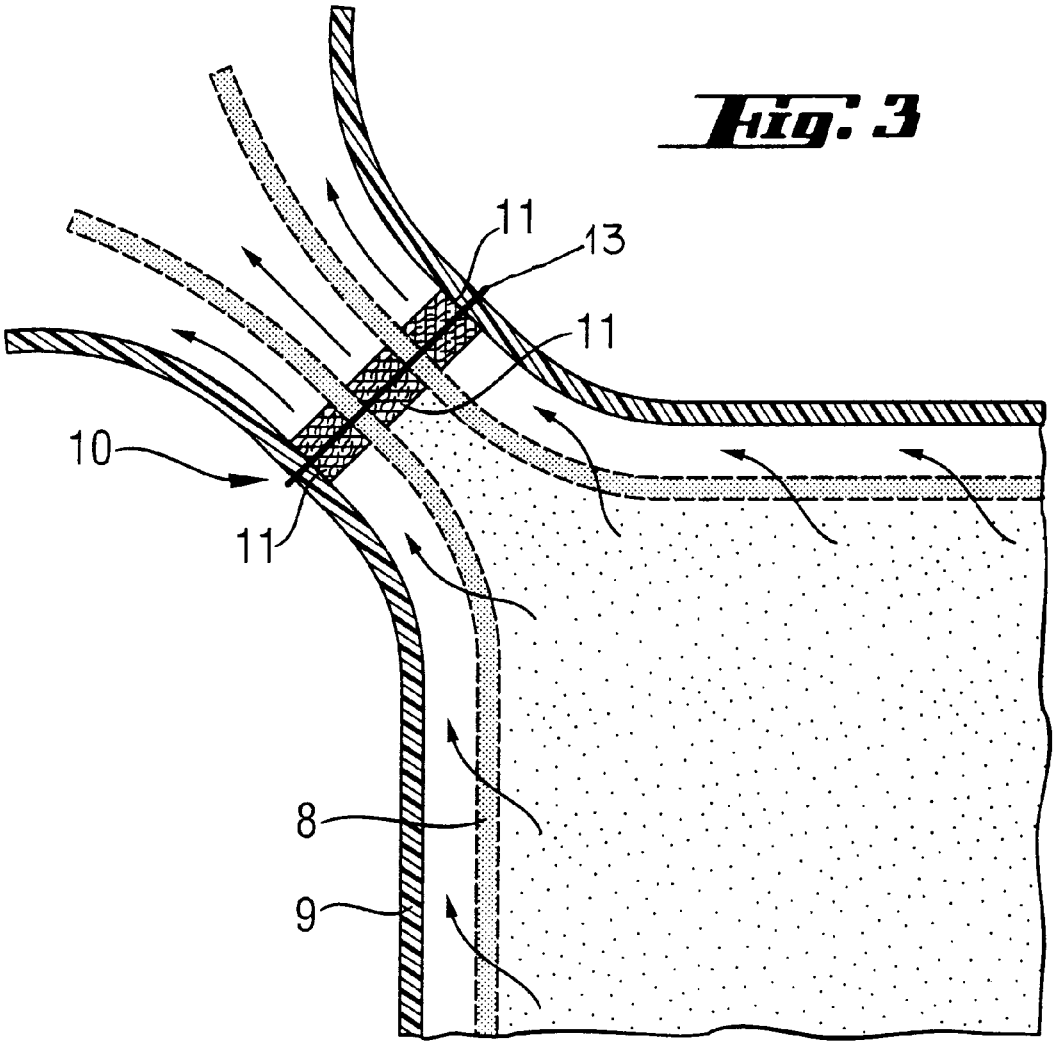
FIG. 3 is an enlarged detailed drawing of the special seam design of the circled area III of FIG. 2.

FIG. 3 shows an enlarged view of the special seam design of FIG. 2. When the drums according to the invention are being filled, the predeaerated HDK material is precipitated on the inner, uncoated layer 8 during vacuum filling. As a result of the already mentioned increase in the degree of agglomeration due to predeaeration, and of the low differential pressure, the possible passage of dust into the interspace between the uncoated air-permeable layer and an outer coated, leaktight layer 9 is only slight. The suction-extracted gas is then led between an inner and an outer layer to the special seams where it is suction-extracted.

FIG. 3 shows means 13 for connecting the inner layers 8 and outer layers 9 together with filter material 11 to define the seam 10, so that the drum can be dearaeted solely through this seam 10 which is retained in position. The seam 10 thusly comprises an air-permeable dust-retaining filter material 11 disposed between the inner layer 8 and outer layer 9, and on the front side and the backside of connecting means 13.

At the same time, the layers of the flexible drum are connected to one another so that, in each case, a strip of air-permeable filter-like material 11 is disposed between the individual layers. By means of these strips, the gas can be suction-extracted and, at the same time, dust particles which could escape through an inner uncoated layer 8 are retained. In this case, all known flexible filter materials, such as, for example, felt strips consisting of natural or synthetic fibers, polyester or teflon model felts, paper filters and/or polypropylene wicks, may be used as filter strips. The inventive limitation of the air-permeable regions to the seams provides a sufficient moisture barrier to the surrounding air. The solid material disposed in the drums can have a bulk density of between 20 to 150 g/l and a filling weight of between 90 to 350 kg.

Accordingly, while a few embodiments of the present invention have been shown and described, it is to be understood that many changes and modifications may be made thereunto without departing from the spirit and scope of the invention as defined in the appended claims.

What is claimed is:

1. A flexible drum for containing high air content solids for the repeated filling and emptying by means of vacuum filling plants, comprising at least an inner and an outer layer disposed adjacent to each other, said inner layer comprising an uncoated air-permeable material;

said outer layer being coated material so as to be dust tight and forms a moisture barrier; and means for connecting the inner and outer layer together to define a seam, said seam comprising an air-permeable dust-retaining filter material disposed between said inner layer and outer layer and said filter material on front side and back side of said means for connecting; so that the drum can be deaerated solely through said seam.

2. The flexible drum as claimed in claim 1, wherein said outer layer is coated with polyethylene or polypropylene.

3. The flexible drum as claimed in claim 1, wherein said filter material comprises a felt strip.

4. The flexible drum as claimed in claim 1, wherein said filter material comprises a polypropylene wick.

5. The flexible drum as claimed in claim 1 wherein said filter material comprises Teflon® felts.

6. The flexible drum as claimed in claim 1, wherein said filter material comprises paper filters.

* * * * *